US007790086B2

(12) United States Patent
Fulwood

(10) Patent No.: US 7,790,086 B2
(45) Date of Patent: Sep. 7, 2010

(54) HINGED POINTER POTTERY SIZING GUIDE

(76) Inventor: John L. Fulwood, 762B Sergeantville Rd., Stockton, NJ (US) 08559

( * ) Notice: Subject to any disclaimer, the term of this patent is extended or adjusted under 35 U.S.C. 154(b) by 0 days.

(21) Appl. No.: 12/315,426

(22) Filed: Dec. 3, 2008

(65) Prior Publication Data

US 2009/0140460 A1 Jun. 4, 2009

Related U.S. Application Data

(60) Provisional application No. 61/005,235, filed on Dec. 3, 2007.

(51) Int. Cl.
*B28B 1/02* (2006.01)
*B28B 1/29* (2006.01)

(52) U.S. Cl. ..... 264/310; 264/309

(58) Field of Classification Search ..... 264/310, 264/309; 425/459
See application file for complete search history.

(56) References Cited

U.S. PATENT DOCUMENTS 1,430,363 A * 9/1922 Dolley ..... 425/267
2,114,254 A * 4/1938 Miller et al. ..... 425/96
2,638,653 A * 5/1953 Adams ..... 425/86
4,057,384 A * 11/1977 Reid ..... 425/459
4,102,622 A * 7/1978 Simpson ..... 425/268
4,217,799 A * 8/1980 Faris ..... 82/1.11
4,585,240 A * 4/1986 Giffin ..... 279/111
5,047,194 A 9/1991 Roufs
7,504,064 B2 * 3/2009 Jo ..... 264/679
2005/0025850 A1 2/2005 D'Estais
2009/0140460 A1 * 6/2009 Fulwood ..... 264/310

OTHER PUBLICATIONS

Jeremiah 18 (KJV).*

* cited by examiner

*Primary Examiner*—Joseph S Del Sole
*Assistant Examiner*—David N Brown, II

(57) ABSTRACT

In embodiments of the present invention improved capabilities are described for reproducing the size of a first ceramic ware in the making of a second ceramic ware. In embodiments, the first ceramic ware may be received on a pottery wheel. A hinged pointer may then be presented to a position on the first ceramic ware, where the hinged pointer may include a pointer connected to a supporting structure by way of a hinge. The first ceramic ware may then be removed from the pottery wheel, and material for the making of the second ceramic ware may be placed on the pottery wheel. The process of making the second ceramic ware may then progress, where the making includes sizing the second ceramic ware to the position of the hinged pointer.

8 Claims, 1 Drawing Sheet

HINGED POINTER POTTERY SIZING GUIDE

CROSS-REFERENCE TO RELATED APPLICATIONS

This application claims the benefit of provisional application 61/005,235 filed Dec. 3, 2007, which is hereby incorporated by reference in its entirety.

BACKGROUND

1. Field

The present invention is related to the making of pottery, and more specifically to the consistent reproduction of pots, or ceramic wares, that are thrown and trimmed on a potter's wheel.

2. Description of the Related Art

Pottery is a ceramic ware, and encompasses a wide range of ceramics, including earthenware, stoneware, porcelain, and the like, which may be more generically referred to as clay in its material form. Pottery is shaped while the clay is in its plastic form, and is often made on a potter's wheel that allows for the shaping and trimming of ceramic wares, which may be more generally referred to as a pot in its final form. Many tools have been developed to aid the potter in the shaping of a pot on the wheel, including paddles, ribs, knives, wires, and the like, which allow the potter to form unique pots more easily. However, once a pot has been produced it may be a challenge to reproduce it in size and shape, especially when the potter is trying to produce some large number of pots for a set, such as a set of bowls, plates, vases, or the like. There exists a need for a device, to be used in conjunction with a potter's wheel, which allows the potter to more easily reproduce the size and shape of a pot in order to produce a matching set of wares.

SUMMARY

In embodiments of the present invention improved capabilities are described for reproducing the size of a first pot, or ceramic ware, in the making of a second pot, such as when a potter needs to make a second or series of pots similar in size to the first pot. In embodiments, the first pot may be placed on a pottery wheel. A hinged pointer of the present invention may then be presented to a position on the first pot, where the hinged pointer may include a pointer connected to a supporting structure by way of a hinge. For instance, the hinged pointer may be positioned at the outer rim of the first pot. The first pot may then be removed from the pottery wheel, and material for the making of the second pot may then be placed on the pottery wheel. The process of making the second pot may then progress, where the making includes sizing the second pot to the position of the hinged pointer.

In embodiments, the hinged pointer may be free to move such that the hinge may be rotated about the hinge to a stored position so that the hinged pointer does not interfere with the making of the second ceramic ware, free to move such that it does not significantly damage the second ceramic ware upon making contact with the second ceramic ware in the making of the second ceramic ware, free to move such that the supporting structure is not substantially moved when the hinged pointer comes in contact with the second ceramic ware in the making of the second ceramic ware, and the like.

In embodiments, the pointer may be shaped to a point at the position nearest the first and second ceramic ware, a rounded shape at the position nearest the first and second ceramic ware, a flat edge at the position nearest the first and second ceramic ware, and the like. In embodiments, the hinge may be a flexible joint. The hinge may be made of a material providing a yielding action between the pointer and the supporting structure.

In embodiments, the first and second ceramic ware may be an item of pottery as thrown on the pottery wheel, where the material may be clay, ceramic, earthware, stoneware, porcelain, and the like.

These and other systems, methods, objects, features, and advantages of the present invention will be apparent to those skilled in the art from the following detailed description of the preferred embodiment and the drawings. All documents mentioned herein are hereby incorporated in their entirety by reference.

BRIEF DESCRIPTION OF THE FIGURES

The invention and the following detailed description of certain embodiments thereof may be understood by reference to the following figure.

Figure 1:
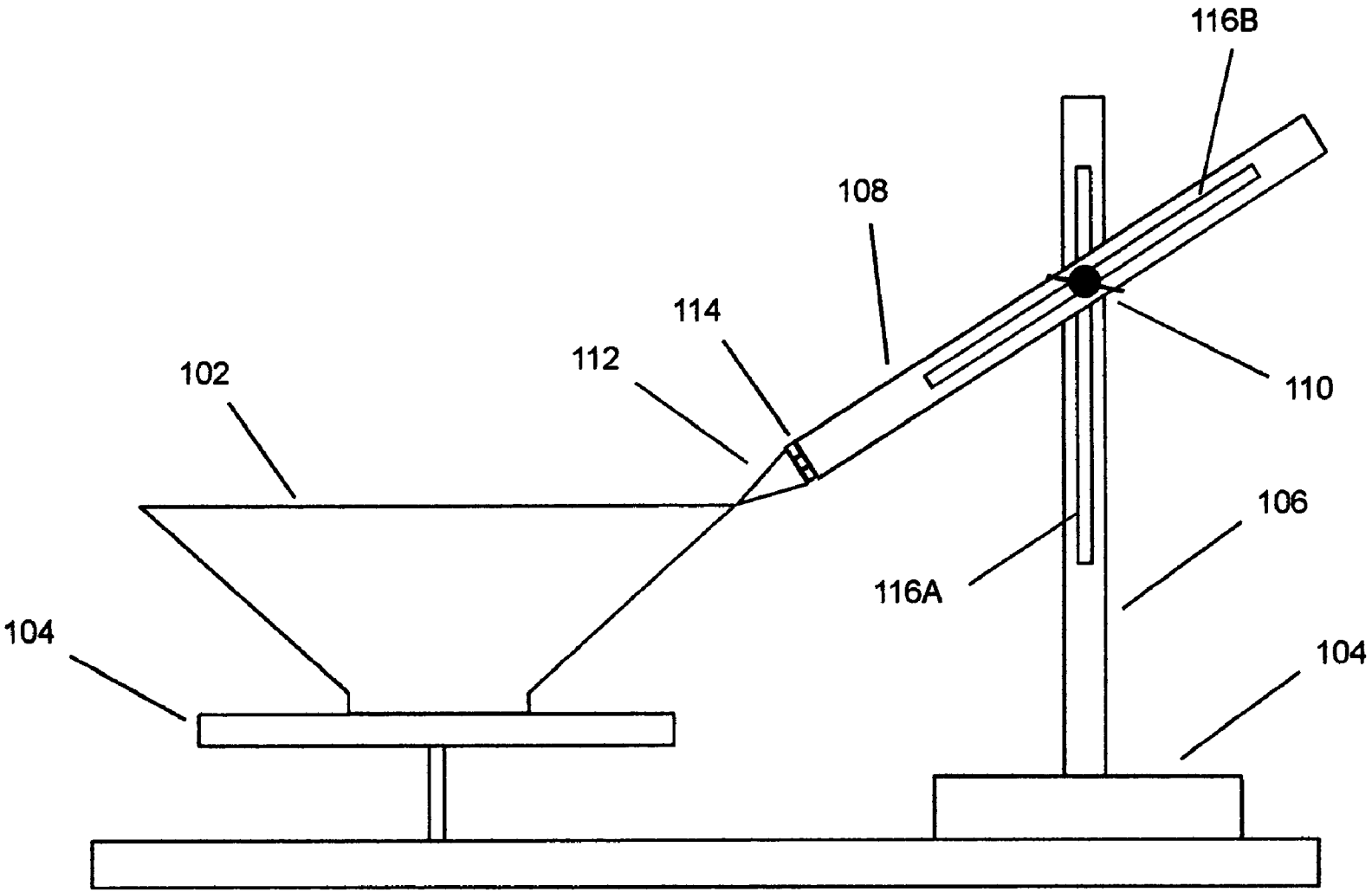
FIG. 1 depicts an embodiment of the invention, shown adjusted to a position at the outer diameter of a pot's rim.

While the invention has been described in connection with certain preferred embodiments, other embodiments would be understood by one of ordinary skill in the art and are encompassed herein.

All documents referenced herein are hereby incorporated by reference.

DETAILED DESCRIPTION

The present invention may be used to help consistently reproduce a ceramic ware 102, commonly referred to as a pot 102, which has been previously made on a potter's wheel 104, such as a bowl, a dish, a platter, a plate, a vase, a jar, a mug, and the like. That is, once the potter has produced a pot 102, they, or others, may want to reproduce it with the same size and shape. The present invention may make it easier and more reliable to make subsequent pots 102 of identical size and shape than by using hand tools such as rulers, calipers, and the like. In using hand tools to measure the pot's 102 dimensions and proportions, the potter may take considerable time measuring each subsequent pot 102, and in the end, still not achieve the desired size consistency. This may be somewhat acceptable when reproducing a single pot 102, but for the potter attempting to reproduce a larger number of identical pots 102, the time involved, and the inherent inconsistency of repeated hand measurements, may be prohibitive. The present invention may be used, in conjunction with a potter's wheel 104, to aid the potter in reproducing the dimensions of the original pot 102 during the making of subsequent pots 102.

A pot 102 made, or shaped, on a potter's wheel 104 may be said to have been 'thrown' on the wheel 104. There may be many techniques for throwing a pot 102 on the potter's wheel 104, and may involve a number of steps, such as throwing a round moist ball of clay down onto the wheel 104, centering the clay on the wheel 104 by applying pressure with the hands, finding the center of the clay with the hands and pushing in until close to the bottom, widening the inside of the clay body by pulling out, pulling up the sides of the clay body with hands placed inside and out, shaping the sides by pulling in or pulling out, rounding the lip using a sponge or a piece of leather, cutting the pot from the wheel with a wire underneath the base of the pot 102, and the like. After the pot 102 is semi-dry, often referred to as being 'leather hard', the pot 102 may be placed back onto the wheel 104, secured with some fresh clay, and trimmed with a cutting tool. The present invention may help the potter reproduce the shape of the original pot during the various steps in the throwing and trimming process.

FIG. 1 shows an embodiment of the present invention, as it may be used to help consistently measure to the outer diameter and height of a pot's 102 rim. By having such a device as the present invention, a series of pots 102, in this case a bowl 102, may be quickly and reliably reproduced with the same dimensions. The present invention, as shown, may provide a measurement guide for the potter to use when shaping the bowl 102. For instance, the potter may use the present invention to mark the position of the rim of the original pot 102. The potter may then take the original pot 102 off the wheel 104, leaving the present invention as a marker in guiding the sizing and shaping of the next pot 102. Now, in making the next piece, the potter may be able to shape the pot 102 using the present invention as a marker. For example, the potter may be in the process of pulling out the sides of the new bowl 102 while the wheel 104 is spinning, where the present invention marks the position where the bowl's 102 rim must be in order to have these same dimensions as the original. When the new bowl 102 is complete, a third bowl 102 may be begun, and the cycle repeats. In the end, the potter may have a complete set of bowls 102 with a consistent size and shape, in this case, a rim that is the same height and the same outer diameter as the original pot.

Referring again to FIG. 1, the present invention may be made up of a plurality of components, such as a base 104, a post 106, an arm 108, an adjustable connection device 110, a pointer 112, a hinge 114, and the like. In an embodiment, the post 106 may be rigidly connected to the base 104, and have a slot 116A cut through it. The arm 108, which may also have a slot 116B cut through it, may be connected to the post 106 with an adjustable connection device 110, such as a wing-nut. Thus, the position of the arm 108 may be freely adjusted up and down along the post, and left and right along the connection point 110, as viewed in FIG. 1. The arm 108 may also be angled, pivoting about the adjustable connection point 110. The potter may make these translational and rotational adjustments until the tip of the pointer 112 is at the desired position, which may be typically set while the original pot is on the wheel 104. The pointer 112 may in turn be attached to the arm 108 with a hinge 114. The present invention, as described in this embodiment, may now be freely adjusted until the tip of the pointer is at a position on the original pot 102 that the potter wants to reproduce on subsequent pots 102. The potter may now tighten the arm 108 and post 106 into rigid contact by tightening down on the adjustable connection device 110. Once the present invention is set into the desired position, the potter may remove the original pot 102 and begin the process of throwing the first reproduction.

In embodiments, the hinge 114 may be an essential component in the system, which may help prevent the process of throwing the new pot 102 from effecting the set position of the pointer 112. That is, as the potter pulls the new pot's 102 clay out and up while throwing, the clay may come in contact with the tip of the pointer 112. If the pointer 112 was rigidly attached to the arm 108, this contact may permanently move the entire assembly, thus providing no further position guidance, that is, to this or any subsequent pot's 102 production. However, by having the pointer 112 attached to the arm 108 by a hinge 114, the pointer 112 may only be temporarily moved out of the way, and may be easily be swung back into position, as the potter needs. In addition, the pointer 112, if rigidly attached to the arm 108, may gouge the clay body as contact is made. A gouge in the clay body, especially one on a critical part of the pot 102, such as the rim of a bowl, may now require reworking, and potentially affect the quality of the end product. By having the pointer 112 connected to the arm 108 by way of a hinge 114, any contact with the clay body may throw the pointer 112 back out of the way, without making any significant mark to the clay body. The action of the pointer being thrown aside may be clear when considering the pot 102 is spinning around at some speed on the wheel 104. Thus, not only does the present invention provide accurate and reproducible results when applied to the reproduction of pottery, but may significantly reduce the potential for gouging of the clay body when contact is made. In embodiments, the hinge 114 may be any device, configuration, or connection that provides a flexible joint, yielding action, and the like, to contact made with it. And although the present invention is described herein as being embodied utilizing a 'hinged' pointer, one skilled in the art will recognize that other configurations of a yielding portion will also serve the intent of the present invention.

In embodiments, the present invention may also include additional hinged 114 pointers 112, such as by providing additional arm 108 assemblies, arm 108 assemblies with multiple hinged 114 pointers 112, multiple posts 106 with additional arm 108 assemblies, and the like. In embodiments, the hinged 114 pointer 112 may be attached to any of a plurality of support structures, such as a flexible bar that comes directly from the base 104 to the hinged 114 pointer 112, a flexible bar that is connected to a rigid post 106, and the like. In embodiments, the hinged 114 pointer 112 may be supported structurally by some component associated with the pottery wheel 104 assembly, that is, where the base 104 is an integral part of the pottery wheel 104 assembly. In embodiments, the pointer 112 may be any one of a plurality of shapes, such as pointed, rounded, square, and the like. In embodiments, the pointer 112, or hinged 114 pointer 112 assembly, may be replaceable or interchangeable, such as for changing shapes, replacement due to damage, and the like.

In addition, wherein the present invention has been described in association with the process of throwing a pot, it should be understood that the present invention may also be used during the trimming process, for example, to reproduce the outer diameter of the foot of a pot during trimming.

While the invention has been described in connection with certain preferred embodiments, other embodiments would be understood by one of ordinary skill in the art and are encompassed herein.

What is claimed is:

1. A method for reproducing the size of a first ceramic ware in the making of a second ceramic ware, comprising:

receiving the first ceramic ware on a pottery wheel, wherein the first ceramic ware has been previously fully formed by way of throwing on the pottery wheel;

presenting a hinged pointer to a position on the first ceramic ware, wherein the hinged pointer includes a pointer connected to a supporting structure by way of a hinge, and where the hinge allows the pointer to freely rotate about the hinge in the event of a physical contact made with the pointer;

removing the first ceramic ware from the pottery wheel while maintaining the previous positioning of the hinged pointer;

placing material for the making of the second ceramic ware on the pottery wheel and progressing through the process of throwing the second ceramic ware, wherein the throwing includes expanding the radius of the second ceramic ware until the second ceramic ware being thrown is expanded to a size where momentary contact is made with the pointer, wherein the momentary contact is determined by the pointer freely rotating about the hinge away from the material of the second ceramic ware such that physical contact between the pointer and the second ceramic ware is terminated immediately after contact; and stopping the expanding of the size of the second ceramic ware in order to allow the size of the second ceramic ware to be consistent with the size of the first ceramic ware.

2. The method of claim 1, wherein the hinged pointer is free to move such that it does not significantly damage the second ceramic ware upon making contact with the second ceramic ware in the making of the second ceramic ware.

3. The method of claim 1, wherein the hinged pointer is free to move such that the supporting structure is not substantially moved when the hinged pointer comes in contact with the second ceramic ware in the making of the second ceramic ware.

4. The method of claim 1, wherein the pointer is shaped to a point at the position nearest the first and second ceramic ware.

5. The method of claim 1, wherein the pointer has a rounded shape at the position nearest the first and second ceramic ware.

6. The method of claim 1, wherein the pointer has a flat edge at the position nearest the first and second ceramic ware.

7. The method of claim 1, wherein the hinge is a flexible joint.

8. The method of claim 1, wherein the hinge is made of a material providing a yielding action between the pointer and the supporting structure.

* * * * *